US012715034B2

(12) United States Patent
Brandt et al.

(10) Patent No.: US 12,715,034 B2
(45) **Date of Patent: *Aug. 25, 2026**

(54) CONTINUOUS CASTING PROCESS OF METAL

(71) Applicant: ARCELORMITTAL INVESTIGACIÓN Y DESARROLLO, S.L., Sestao Bizkaia (ES)

(72) Inventors: Mathieu Brandt, Liege (BE); Jean-Paul Fischbach, Neupre (BE); Paul Naveau, Alleur (BE)

(73) Assignee: ARCELORMITTAL INVESTIGACIÓN Y DESARROLLO, S.L., Sestao Bizkaia (ES)

( * ) Notice: Subject to any disclaimer, the term of this patent is extended or adjusted under 35 U.S.C. 154(b) by 0 days.

This patent is subject to a terminal disclaimer.

(21) Appl. No.: 18/748,604

(22) Filed: Jun. 20, 2024

(65) Prior Publication Data

US 2024/0335873 A1 Oct. 10, 2024

Related U.S. Application Data

(63) Continuation of application No. 14/385,046, filed as application No. PCT/IB2012/000628 on Mar. 28, 2012, now Pat. No. 12,157,165.

(51) Int. Cl.
*B22D 11/11* (2006.01)
*B22D 11/04* (2006.01)
(Continued)

(52) U.S. Cl.
CPC ..... *B22D 11/11* (2013.01); *B22D 11/103* (2013.01); *B22D 11/108* (2013.01); *B22D 41/58* (2013.01); *B22D 11/04* (2013.01)

(58) Field of Classification Search
CPC ... B22D 11/103; B22D 11/106; B22D 11/108; B22D 41/50; B22D 41/58; B22D 41/60
See application file for complete search history.

(56) References Cited

U.S. PATENT DOCUMENTS 3,702,151 A 11/1972 De Blok et al.
3,911,993 A 10/1975 Caudill et al.
(Continued)

FOREIGN PATENT DOCUMENTS

CN 1116414 A 2/1996
CN 1753743 A 3/2003
(Continued)

OTHER PUBLICATIONS

A partial translation of JPS49333Y1, Jan. 8, 1974.
(Continued)

*Primary Examiner* — Keith Walker
*Assistant Examiner* — Jacky Yuen
(74) *Attorney, Agent, or Firm* — Davidson Kappel LLC

(57) ABSTRACT

A continuous casting process of a steel semi-product is provided. The process includes a step of casting using a hollow jet nozzle located between a tundish and a continuous casting mould. The nozzle includes, in its upper part, a dome for deflecting the liquid metal arriving at the inlet of the nozzle towards the internal wall of the nozzle, defining an internal volume with no liquid metal. A simultaneous step of injecting powder through a hole of the dome occurs. The powder has a particle size of 200 μm or less. The dome includes a first device to inject the powder without any contact with the dome and a second device to avoid sticking or sintering of the powder onto the first device.

11 Claims, 3 Drawing Sheets

(51) Int. Cl.

| | |
|---|---|
| ***B22D 11/103*** | (2006.01) |
| ***B22D 11/108*** | (2006.01) |
| ***B22D 41/58*** | (2006.01) |

(56) References Cited

U.S. PATENT DOCUMENTS

| | | | |
|---|---|---|---|
| 3,970,135 | A | 7/1976 | Schmid et al. |
| 4,520,861 | A | 6/1985 | Sobolewski et al. |
| 4,524,819 | A | 6/1985 | Yoshimura |
| 4,792,126 | A | 12/1988 | Nagy et al. |
| 4,874,471 | A | 10/1989 | Wilmotte |
| 4,941,646 | A | 7/1990 | Stelts et al. |
| 5,350,158 | A | 9/1994 | Whellock |
| 6,321,766 | B1 | 11/2001 | Nathenson |
| 2007/0074846 | A1 | 4/2007 | Sommerhofer et al. |
| 2009/0266506 | A1 | 10/2009 | Naveau et al. |
| 2009/0277600 | A1 | 11/2009 | Cho et al. |
| 2010/0278684 | A1 | 11/2010 | Damasse et al. |

FOREIGN PATENT DOCUMENTS

| | | | |
|---|---|---|---|
| EP | 0269180 | B1 | 1/1992 |
| EP | 0605379 | B1 | 7/1997 |
| EP | 2099576 | B1 | 5/2010 |
| JP | S49333 | Y1 | 1/1974 |
| JP | H02235557 | A | 9/1990 |
| JP | H0745095 | B2 | 5/1995 |
| JP | H08506278 | A | 7/1996 |
| JP | H10211563 | A | 8/1998 |
| JP | 2008532772 | A | 8/2008 |
| KR | 200166037 | Y1 | 2/2000 |
| SU | 416149 | A1 | 2/1974 |
| SU | 986588 | A1 | 1/1983 |
| WO | WO9515234 | A1 | 6/1995 |
| WO | WO 2008070935 | A1 | 6/2008 |

OTHER PUBLICATIONS

Naveau, P.: "An Original Casting Technique for an Enhanced Control on the Composition and Structure of Steel Semis," 4$^{th}$ European Continuous Casting Conference, Birmingham, Oct. 2002, IOM Communications, 2002, pp. 94-103, vol. 1.

CONTINUOUS CASTING PROCESS OF METAL

The present inve ntion relates to a continuous casting process. In particular, the invention relates to a continuous casting process, called Hollow Jet Casting, in which powder is injected into a hollow jet of metal. The term metal will be understood in the rest of the text as including pure metals or metal alloys.

BACKGROUND

The continuous casting of steel is a well-known process. It consists in pouring a liquid metal from a ladle into a tundish intended to regulate the flow and then, after this tundish, in pouring the metal into the upper part of a water-cooled bottomless copper mould undergoing a vertical reciprocating movement. The solidified semi finished product is extracted from the lower part of the mould by rollers. The liquid steel is introduced into the mould by means of a tubular duct called a nozzle placed between the tundish and the mould.

Document EP 0 269 180 B1 describes a specific continuous casting process called "Hollow Jet Casting" in which the liquid metal is poured onto the top of a dome made of a refractory material. The shape of this dome causes the metal to flow towards its periphery, the flow being deflected towards the internal wall of the nozzle or of an intermediate vertical tubular member. Said intermediate vertical tubular member can be a copper tube 3 cooled by a water jacket 4 as illustrated in FIG. 1 and topped by a refractory ring 5. What is thus created, in the central part of the nozzle beneath the tundish member, is a volume without any liquid metal within which it is possible to carry out additions via an injection channel. The device thus described is referred to as a "Hollow Jet Nozzle (HJN)".

A powder can be injected in the center of the hollow jet created by the refractory dome. This injection technique is disclosed in the document EP 0 605 379 B1. This powder injection aims to create an additional cooling of the liquid steel by the melting of the metallic powder or to modify the composition of the steel during casting by addition of other metallic elements such as ferro-alloys. As disclosed in document EP 2 099 576 B1, the powder can be transported via a mechanical screw feeder and is fed by gravity in a hole going through the refractory dome. Generally, the hole goes through one of the support arms of the dome intended for securing the dome to the vertical tubular member.

SUMMARY OF THE INVENTION

However problems occur when powder with a size range of 200 μm or less is injected. Indeed after a short time injection means are plugged and injection cannot be longer performed.

An object of the present invention is to provide a continuous casting process in which plugging of the powder injection means is avoided and powder can be injected during the full casting sequence.

The present invention provides a continuous casting process of a steel semi-product comprising a step of casting using a hollow jet nozzle located between a tundish and a continuous casting mould. The nozzle includes, in its upper part, a dome for deflecting the liquid metal arriving at the inlet of said nozzle towards the internal wall of the nozzle, thus defining an internal volume with no liquid metal and a simultaneous step of injection of powder through a hole of the dome, said powder having a particle size of 200 μm or less and said dome including first means to inject said powder without any contact with said dome and second means to avoid sticking or sintering of said powder onto said first means.

In further preferred embodiments, taken alone or in combination, the process may also include the following features:

said first means comprise a hollow body;
said hollow body comprises a double wall in which gas is circulating;
said gas is nitrogen;
a powder feeder is partly disposed in the hollow body;
the powder feeder goes through a support arm of the dome;
said second means comprise means for rotating the hollow body about its longitudinal axis;
said second means comprise means for vibrating the hollow body inside the hole;
said means for vibrating the hollow body comprise a mechanical vibrator or an ultrasound vibrator;
an insulating layer is disposed inside the hole between the dome and the hollow body to create a thermal barrier;
said insulating layer comprises ceramic fibers;
said hollow body is a tube with a circular section;
the inner diameter of said tube ranges from 8 to 30 mm.

The present invention further provides continuous casting equipment as defined above.

BRIEF DESCRIPTION OF THE DRAWINGS

Other features and advantages of the invention will become apparent on reading the following detailed description given solely by way of non-limiting example, with reference to the appended figures in which:

FIG. 2 also represents a section view A-A of the injection tube.

Figure 1:
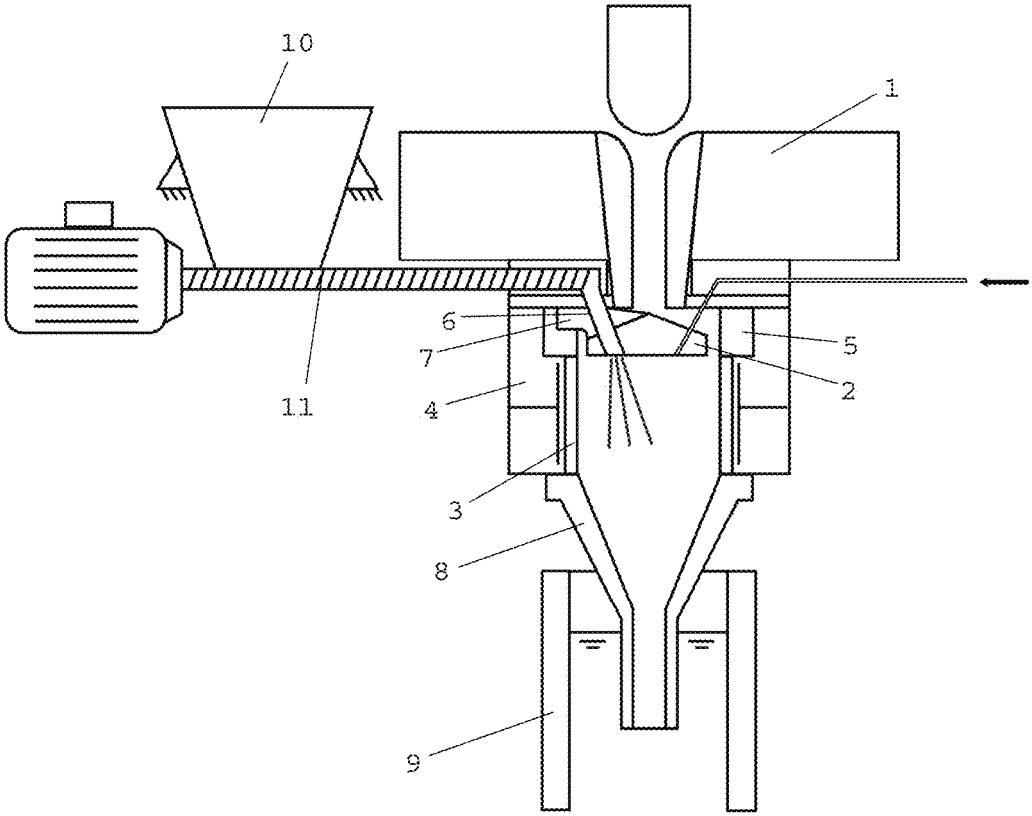
FIG.1 PRIOR ART
FIG. 1 represents a section view of continuous casting equipment as previously referred as hollow jet nozzle according to the prior art.

LEGEND (1) Tundish
(2) Refractory dome
(3) Copper tube
(4) Water cooling jacket
(5) Refractory ring
(6) Hole
(7) Support arm
(8) Submerged entry nozzle
(9) Mould
(10) Powder container
(11) Powder feeder
(12) Hollow body
(13) Double wall
(14) Insulating layer
(15) Vibration means

DETAILED DESCRIPTION

The present invention relates to a continuous casting process in which a flow of liquid metal is poured from a tundish into a ingot mould through the hollow jet nozzle (HJN). A hole is made through the dome 2 of the HJN, and in particular through one of the support arm 7 of the dome 2, to allow the injection of powder in the melt, as already known from the prior art.

During the injection, the metallic powder flowing through the hole is in direct contact with the refractory dome that is at a very high temperature (up to 1200° C.). Inventors have discovered that despite the very short contact time between the particles and the refractory material, it is sufficient to gradually stick the particles together and to sinter them. A cluster of sintered powder is then formed after some minutes of casting and can lead to the full plugging of the powder injector. For example, an injection hole of 20 mm diameter is fully plugged after about 10 minutes of casting when using an iron powder with a size range between 100 and 180 μm.

With particles of a powder having a size of 200 μm or more, the problem does not occur, as particles do not stick together in the lapse of time during which they are in direct contact with the refractory dome.

According to the invention, first means are provided to prevent a direct contact between the dome 2 at high temperature (approximately between 1000 and 1300° C.) and the powder during injection. Said first means comprise a hollow body 12, for example, extending inside the hole 6 of the dome 2, the powder being injected inside the hollow body 12 during casting. This hollow body 12 may have any suitable shape as long as it creates a physical barrier between the dome 2 and the powder. For example, as illustrated in FIG. 2 to 5 for different embodiments of the invention, the hollow body may be a tube with a circular section; it can be made of a refractory material or metal such as low carbon steel. The inner diameter of said tube depends on the powder flow rate to be injected and can, for example, range from 8 to 30 mm for a powder flow rate between 1 and 7 kg/min.

In addition to said first means, second means are provided for preventing the sticking and sintering of the powder inside the hollow body. They are described in FIGS. 2 to 5 in different embodiments. These second means according to the different embodiments allow reducing the surface temperature of the inner wall of the hollow body 12 and thereby reducing the heating of the powder. The second means may be a second device that is a cooling device, for example.

Figure 2:
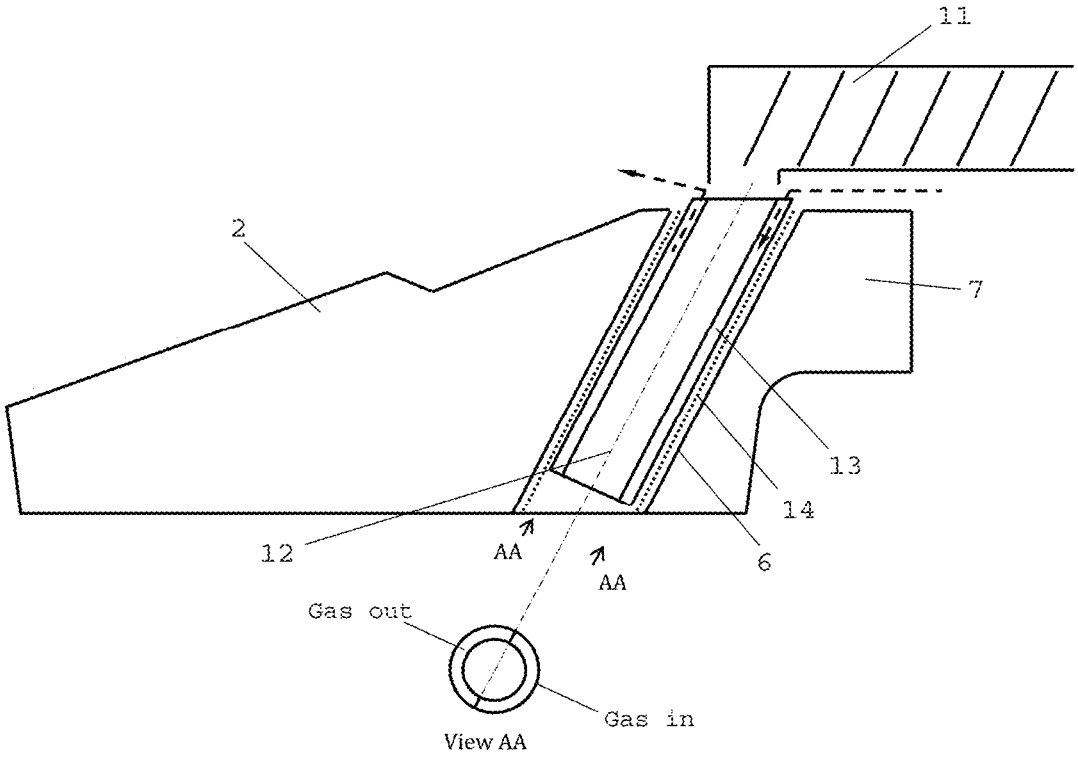
FIG. 2 represents a section view of the dome according to a first embodiment of the invention.

In a first embodiment of the present invention as illustrated in FIG. 2, said hollow body 12 has a double wall 13 cooled by gas. The gas inlet and outlet in the double wall 13 are respectively illustrated by dashed arrows in FIG. 2. The external and internal walls can have, for example, a thickness of 2 mm and the thickness of the gas film in the double wall can be of about 1.5 mm. The gas can be nitrogen or any other suitable gas and circulates usually in the double wall with a flow rate ranging from 10 to 30 m/h. In a preferred embodiment said gas circulates in closed loop in order to avoid any gas injection inside the nozzle which could disturb the liquid steel flow and the good working of the casting equipment. In addition to this gas cooling, the hollow body 12 can also be wrapped in an insulating layer 14 to create a thermal barrier between the hollow body 12 and the refractory dome 2. The continuous casting equipment can also be provided with means for measuring the temperature and the gas flow rate at the inlet and outlet of the cooling device.

Figure 3:
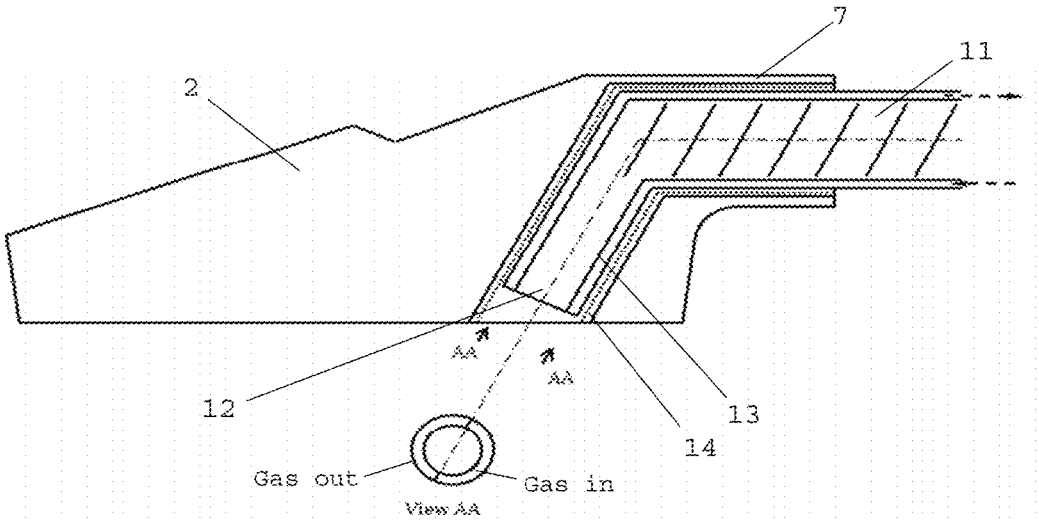
FIG. 3 represents a section view of the dome according to a second embodiment of the invention.

In FIG. 2, the powder feeder 11, which is preferably a screw feeder, is disposed above the dome 2. In another embodiment the hollow body 12 has the shape of a bent tube and the powder feeder 11 is partly located into said hollow body 12 inside the dome 2. As illustrated in FIG. 3 the hollow body 12 with a shape of the bent tube can also goes through a support arm 7 of the dome 2 and the powder feeder 11 is partly located into said hollow body 12 and goes through said support arm 7. This configuration allows gaining space to reduce the size of the equipment.

Trials performed with casting equipment according to this first embodiment of the present invention and with injection of powder having particles size ranging between 100 and 200 μm, for example, have shown a drastic improvement of the duration of the injection without any plugging problem.

Figure 4:
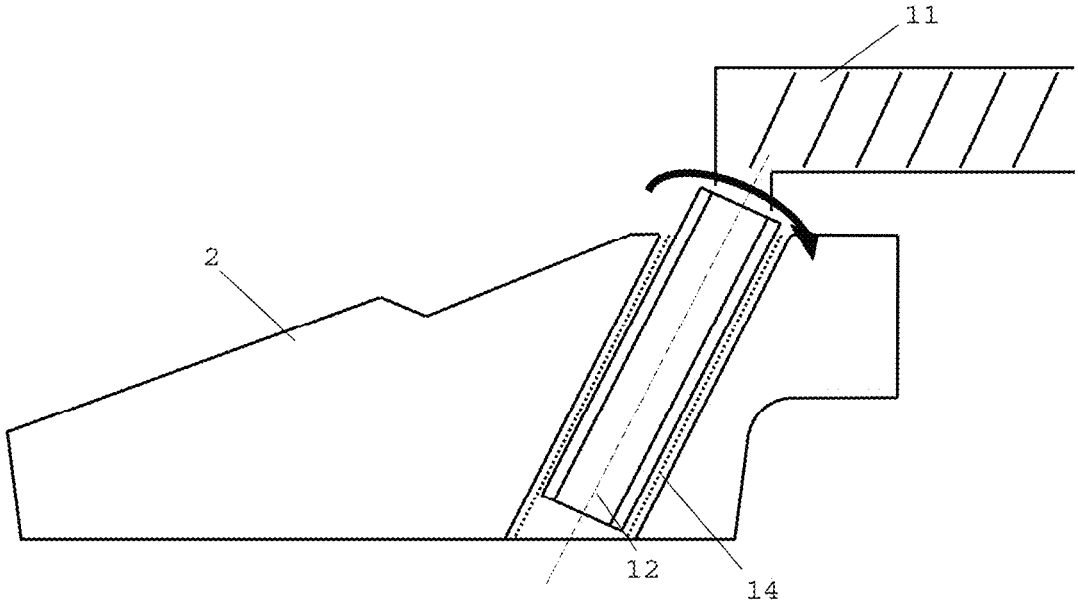
FIG. 4 represents a section view of the dome according to a third embodiment of the invention.

In another embodiment of the invention as illustrated in FIG. 4, the hollow body 12 is rotary mounted about the longitudinal axis of the hole. The rotation of the hollow body 12 allows creating shear stresses on the particles in order to avoid their possible sintering or sticking on the hollow body 12 and to obtain a cooling of the hollow body 12 by the heat exchange between this latter and the powder. The hollow body 12, as illustrated in FIG. 4, is a double wall hollow body as previously described, but in another embodiment, not illustrated, it could be a single tube without gas circulation. As in the previous embodiments, said hollow body 12 can be isolated from the refractory dome 2 by an insulating layer 14.

Figure 5:
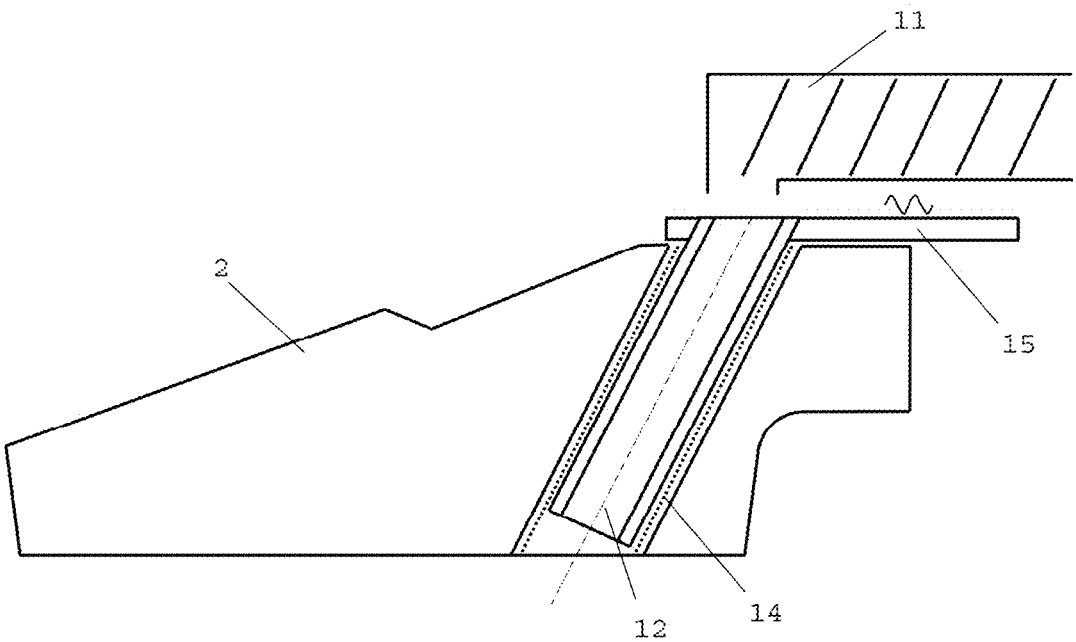
FIG. 5 represents a section view of the dome according to a fourth embodiment of the invention.

In another embodiment of the invention as illustrated in FIG. 5, the hollow body 12 is mounted in such a way that it may vibrate in the hole. The vibration applied to the hollow body 12 allows avoiding the formation of powder clusters inside the hollow body. The vibration can be generated by a mechanical vibrator, by ultrasounds or by other adequate means 15 creating high frequency vibrations, between 50 and 500 HZ. The hollow body 12 can also be wrapped with an insulating layer 14 to reduce the inner surface temperature of the hollow body 12.

In this embodiment the powder feeder 11 is located above the dome 2 but in another embodiment, not illustrated, it could be located into the hollow body 12 having a shape of a bent tube.

For all embodiments, the insulating layers can be made up of ceramic fibers which are resistant to high temperatures, such as 1300° C.

The powder used for injection can be of any type, i.e. metallic or ceramic, or a mixture of different powder types.

What is claimed is:

1. A continuous casting process of a steel semi-product comprising:

casting, using a hollow jet nozzle located between a tundish and a continuous casting mould, the nozzle including, in an upper part, a dome for deflecting liquid metal arriving at an inlet of the nozzle towards an internal wall of the nozzle, thereby defining an internal volume with no liquid metal; and injecting, simultaneously, powder through a hole of the dome, the powder having a particle size of 200 μm or less, the dome including a first device to inject the powder without any contact with the dome, the first device including a hollow body passing through the hole of the dome, said hollow body having a double wall, circulating a cooling gas inside the double wall via an inlet on an end of the double wall during the injecting, exhausting the cooling gas from the double wall via an outlet on said end of the double wall, during the injecting.

2. The continuous casting process according to claim 1, wherein the cooling gas circulates in the double wall with a flow rate ranging from 10 to 30 $m^3$/h.

3. The continuous casting process according to claim 1, wherein the gas is nitrogen.

4. The continuous casting process according to claim 1, wherein the hollow body is a tube with a circular section.

5. The continuous casting process according to claim 4, wherein an inner diameter of the tube ranges from 8 to 30 mm.

6. The continuous casting process according to claim 4, wherein the inlet and the outlet of the double wall are arranged out of the dome.

7. The continuous casting process according to claim 1, wherein the double wall comprises an inner wall and an outer wall, the powder being in contact with an internal surface of the inner wall during the injecting, the outer wall being arranged away from an inner surface of the hole of the dome.

8. The continuous casting process according to claim 7, wherein an external surface of the inner wall and an internal surface of the outer wall define a gas input channel and a gas outlet channel, the gas circulating in the gas input channel in a first direction and the gas circulating in the gas outlet channel in a second direction opposite to the first direction.

9. The continuous casting process according to claim 8, wherein the gas circulating in the gas input channel is in contact with the external surface of the inner wall and with the internal surface of the outer wall, and the gas circulating in the gas outlet channel is in contact with the external surface of the inner wall and with the internal surface of the outer wall.

10. The continuous casting process according to claim 9, further comprising a plurality of transverse walls extending radially from the inner wall to the outer wall.

11. The continuous casting process according to claim 1, wherein the hollow body has an injection outlet, from which the powder is injected into the mould, the injection outlet of the hollow body being contained in the hole of the dome.

* * * * *